US011479974B2

(12) United States Patent
Newton

(10) Patent No.: US 11,479,974 B2
(45) Date of Patent: Oct. 25, 2022

(54) ROOFING TOOL ASSEMBLY

(71) Applicant: Richard Newton, Puyallup, WA (US)

(72) Inventor: Richard Newton, Puyallup, WA (US)

( * ) Notice: Subject to any disclaimer, the term of this patent is extended or adjusted under 35 U.S.C. 154(b) by 356 days.

(21) Appl. No.: 16/705,725

(22) Filed: Dec. 6, 2019

(65) Prior Publication Data

US 2021/0172176 A1 Jun. 10, 2021

(51) Int. Cl.
*E04D 15/06* (2006.01)
*E04D 15/04* (2006.01)
*A47F 13/06* (2006.01)

(52) U.S. Cl.
CPC ..... *E04D 15/06* (2013.01); *A47F 13/06* (2013.01); *E04D 15/04* (2013.01)

(58) Field of Classification Search
CPC ..... E04D 15/04; E04D 15/06; B65G 7/08; B65G 7/10; A47F 13/06
USPC ..... 294/4, 17, 175, 210, 211; 254/129, 131, 254/131.5
See application file for complete search history.

(56) References Cited

U.S. PATENT DOCUMENTS 138,055 A 4/1873 Tamplin
1,519,228 A 12/1924 Weber
2,693,935 A * 11/1954 Halbert ..... B65G 7/12 254/131
2,872,888 A * 2/1959 Kearney ..... B23K 37/0533 269/55
3,531,148 A 9/1970 Rohde
3,615,073 A * 10/1971 Lickey ..... B66F 15/00 254/131
4,433,829 A * 2/1984 Grover ..... B65G 7/12 254/131
4,477,972 A * 10/1984 Testa, Jr. ..... E04D 15/003 254/131.5
4,793,646 A * 12/1988 Michaud, Jr. ..... B63B 21/54 114/221 R
4,881,338 A 11/1989 Lung
5,176,487 A * 1/1993 Flitton ..... B60B 29/002 254/131
6,308,489 B1 * 10/2001 Romes ..... E04D 15/06 52/742.12
6,676,111 B2 * 1/2004 Bigham ..... B66F 19/005 254/131
6,964,442 B1 * 11/2005 Radcliff ..... B27B 21/00 254/131
7,354,084 B2 4/2008 Freiling
7,673,912 B2 3/2010 Breininger
7,726,713 B2 6/2010 Oleksia
8,480,058 B2 * 7/2013 Matthews ..... E04F 21/1894 254/30
2014/0145127 A1 * 5/2014 Su ..... B66F 15/00 254/129

* cited by examiner

*Primary Examiner* — Dean J Kramer

(57) ABSTRACT

A roofing tool assembly for rolling and transporting a roll of roofing paper includes a handle that has a first portion which slidably engages a second portion such that the handle has a telescopically adjustable length. A grip is coupled around the handle to enhance gripping the handle. A tube is coupled to the handle and the tube is curved to conform to the curvature of a roll of roofing paper. In this way the roll of roofing paper can be rolled without requiring the user to stand on the roll of roofing paper. A skid plate is coupled to the tube such that the skid plate can be dragged along a support surface for transporting the roll of roofing paper.

5 Claims, 6 Drawing Sheets

ROOFING TOOL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to roofing devices and more particularly pertains to a new roofing device for rolling and transporting a roll of roofing paper.

(2) Description of Related Art Including Information Disclosed Under 37 CFR 1.97 and 1.98

The prior art relates to roofing devices. The prior art discloses a handle with a hook thereon for guiding and rolling barrels by engaging an end of the barrel as the barrel is being rolled. Additionally, the prior art discloses a hooked tool for cutting slots into a commutator. The prior art discloses a tool carrying device that has an extendable hook thereon for carrying tools. The prior art further discloses a fishing gaff with a telescopic handle. The prior art discloses a lifting tool that includes a foot extending away from a handle thereby facilitating the foot to lift an object when the handle is tilted. Finally, the prior art discloses a cargo grapple that includes a telescopic handle and member with a hooked end for dragging cargo on a trailer or the like.

BRIEF SUMMARY OF THE INVENTION

An embodiment of the disclosure meets the needs presented above by generally comprising a handle that has a first portion which slidably engages a second portion such that the handle has a telescopically adjustable length. A grip is coupled around the handle to enhance gripping the handle. A tube is coupled to the handle and the tube is curved to conform to the curvature of a roll of roofing paper. In this way the roll of roofing paper can be rolled without requiring the user to stand on the roll of roofing paper. A skid plate is coupled to the tube such that the skid plate can be dragged along a support surface for transporting the roll of roofing paper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
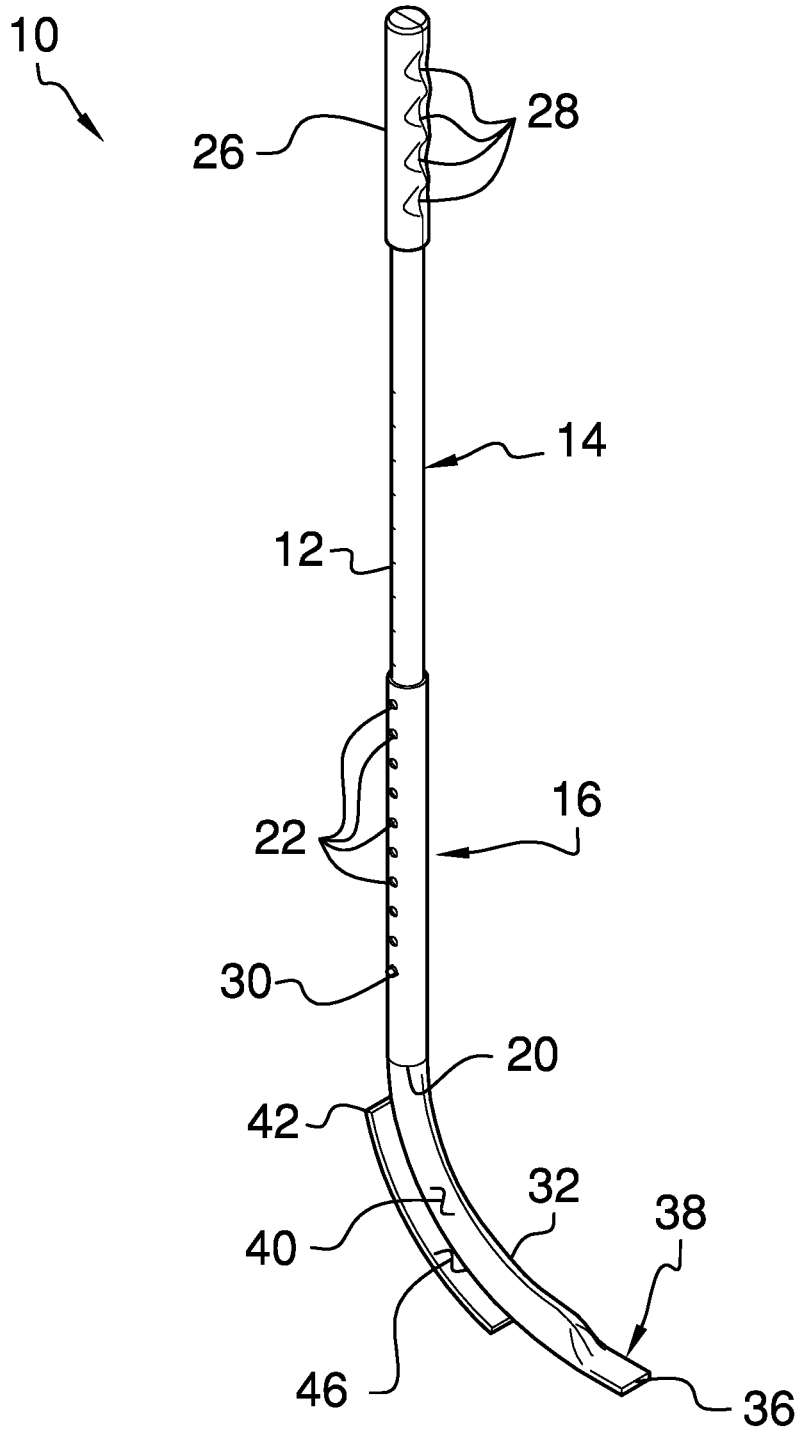
FIG. 1 is a perspective view of a roofing tool assembly according to an embodiment of the disclosure.
Figure 2:
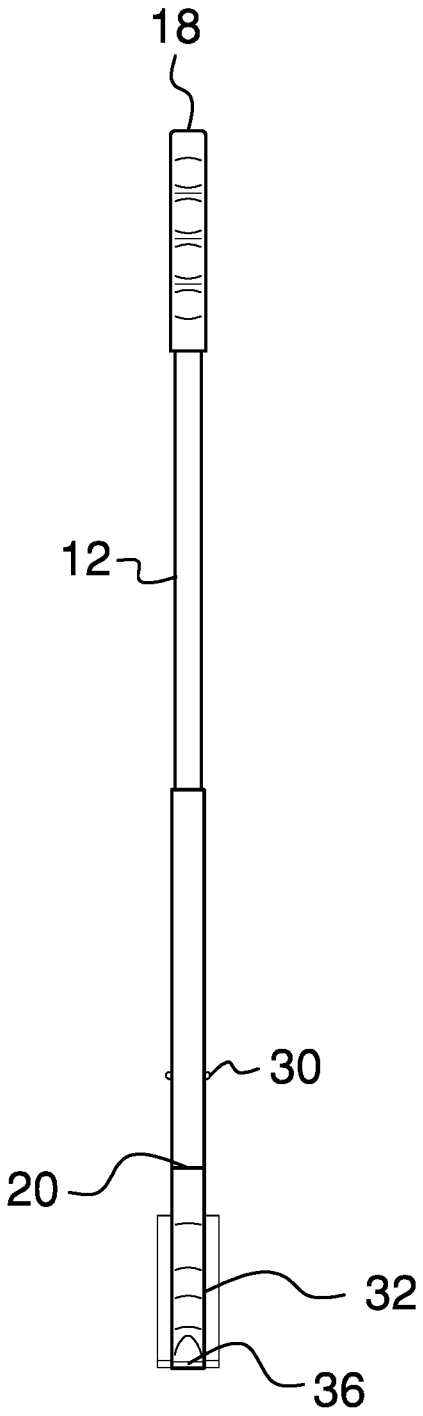
FIG. 2 is a front view of an embodiment of the disclosure.
Figure 3:
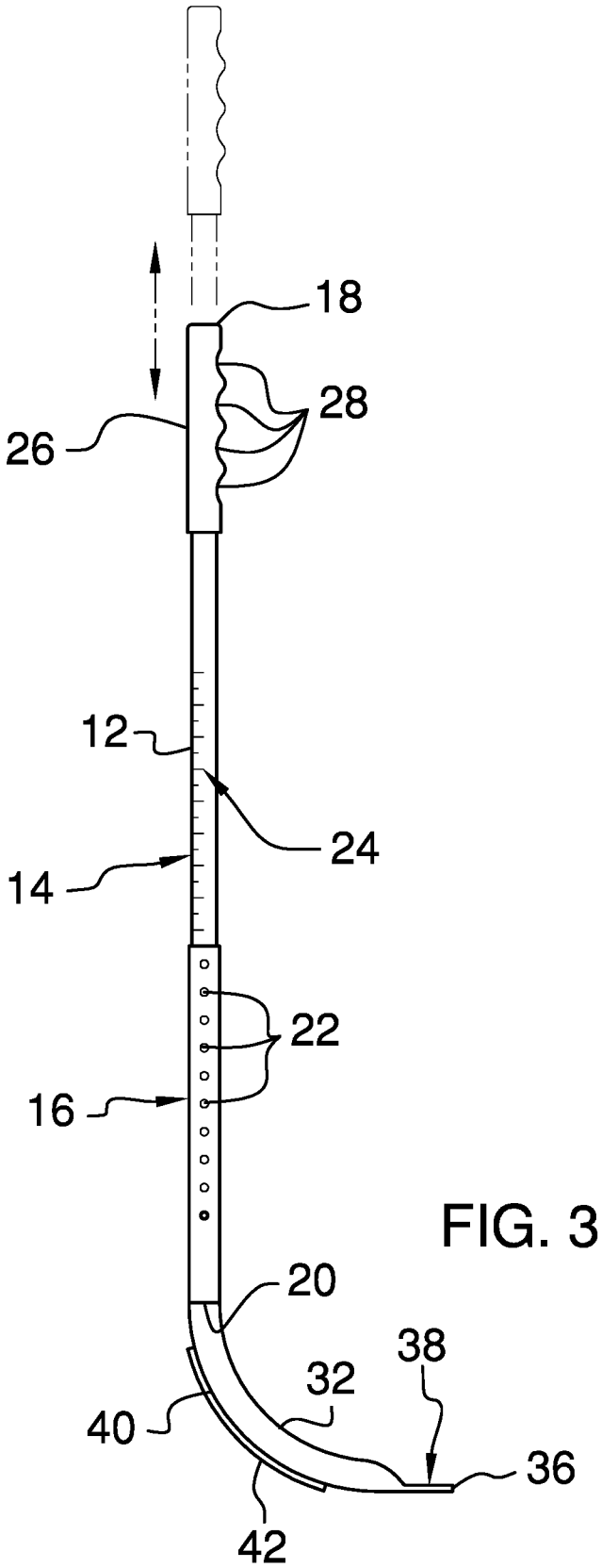
FIG. 3 is a right side view of an embodiment of the disclosure.
Figure 4:
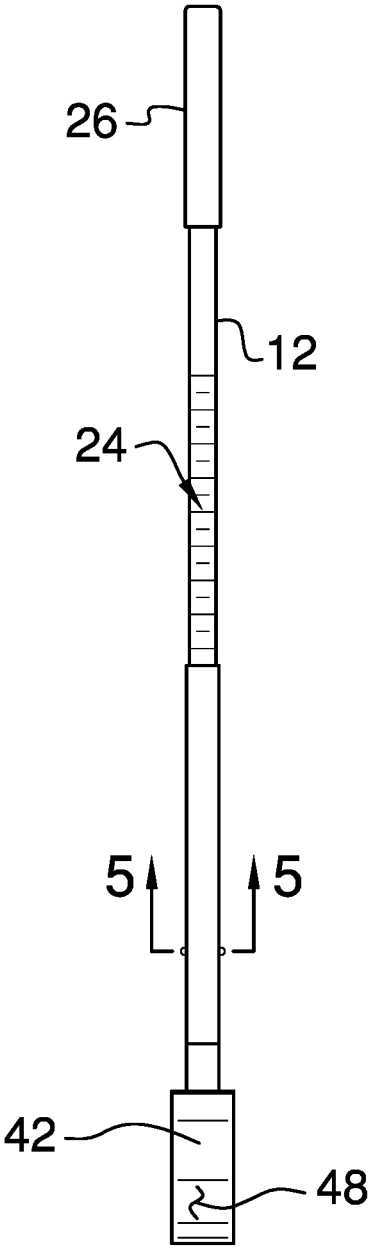
FIG. 4 is a back view of an embodiment of the disclosure.
Figure 5:
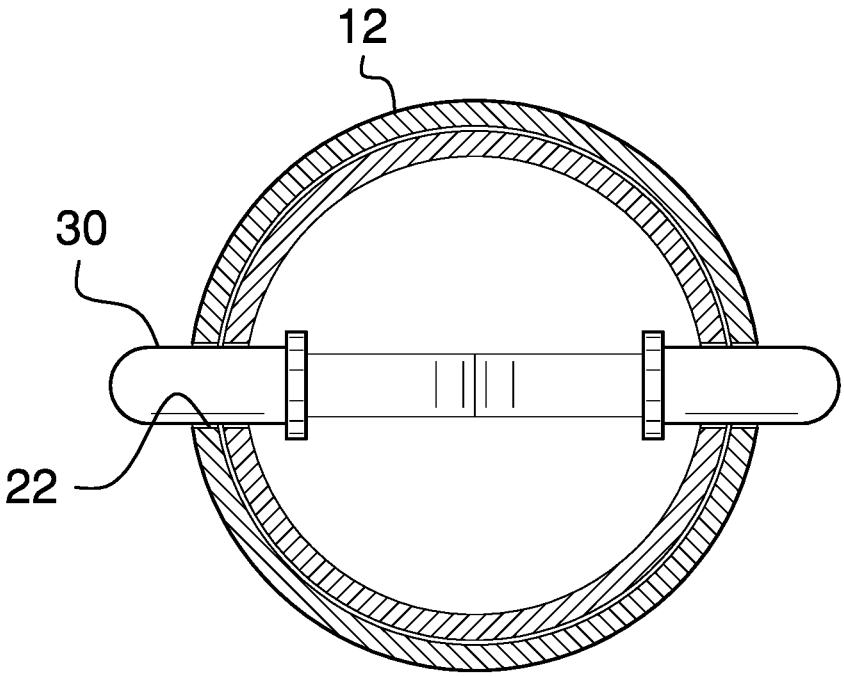
FIG. 5 is a cross sectional view taken along line 5-5 of FIG. 4 of an embodiment of the disclosure.
Figure 6:
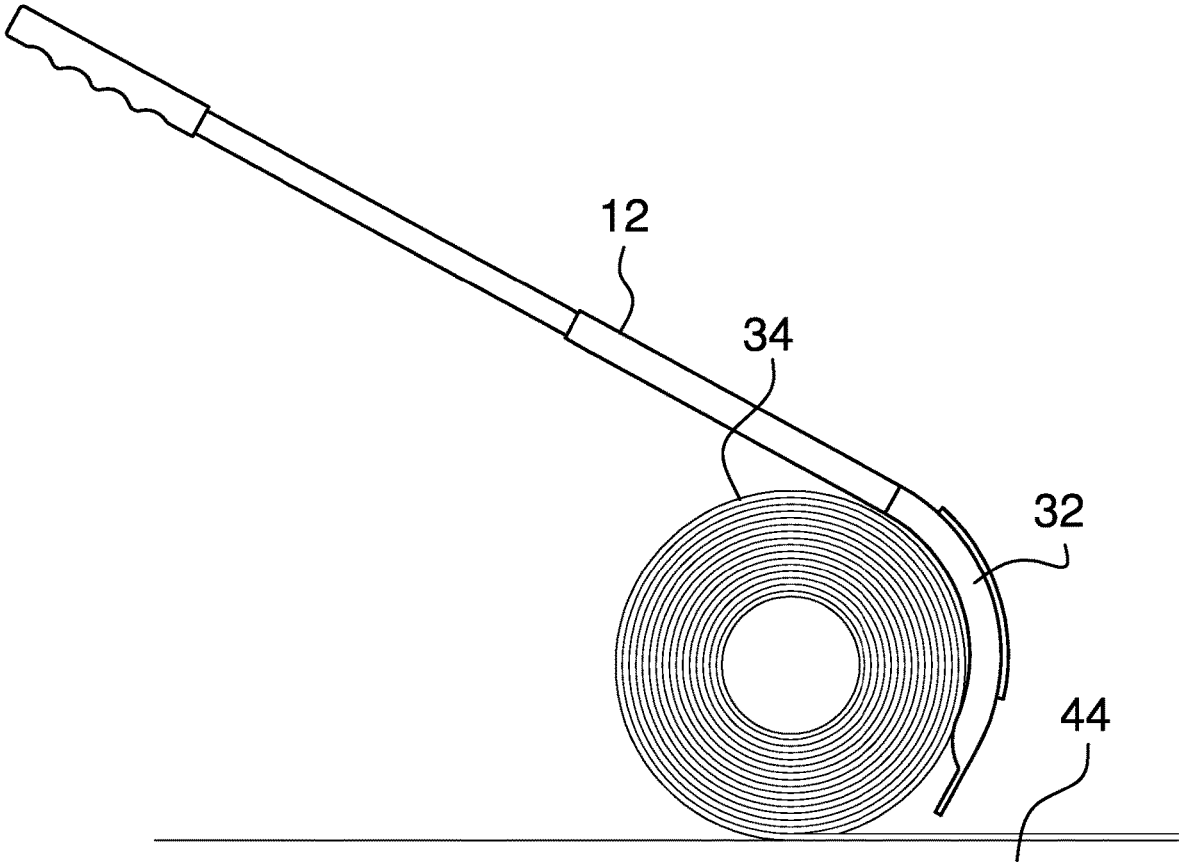
FIG. 6 is a perspective in-use view of an embodiment of the disclosure.

With reference now to the drawings, and in particular to FIGS. 1 through 6 thereof, a new roofing device embodying the principles and concepts of an embodiment of the disclosure and generally designated by the reference numeral 10 will be described.

As best illustrated in FIGS. 1 through 6, the roofing tool assembly 10 generally comprises a handle 12 that has a first portion 14 slidably engaging a second portion 16 such that the handle 12 has a telescopically adjustable length. The handle 12 has a first end 18 that is associated with the first portion 14. The handle 12 has a second end 20 is associated with the second portion 16. The second portion 16 has a plurality of engagement points 22 thereon. The engagement points 22 are spaced apart from each other and are distributed along the second portion 16.

The first portion 14 has measuring indicia 24 printed thereon. The measuring indicia 24 comprise a graduated scale for measuring length. A grip 26 is coupled around the handle 12 to enhance gripping the handle 12 and the grip 26 is positioned on the first end 18. The grip 26 has a plurality of finger indentations 28 therein for receiving the user's fingers when the user grips the grip 26. Additionally, the grip 26 is comprised of a resiliently compressible material to reduce the likelihood of developing blisters from gripping the handle 12.

A lock 30 is movably coupled to the first portion 14 of the handle 12. The lock 30 releasably engages a respective one of the engagement points 22 on the second portion 16 for retaining the handle 12 at a selected length. The lock 30 may include a button that is movably positioned on the first portion 14 and a biasing member that biases the button outwardly from the first portion 14. The plurality of engagement points 22 may comprise apertures through which the button can extend.

A tube 32 is coupled to the handle 12 and the tube 32 is curved to conform to the curvature of a roll of roofing paper 34. In this way the roll of roofing paper 34 can be rolled without requiring the user to stand on the roll of roofing paper 34. The roll of roofing paper 34 may comprise bituminous paper or other similar type of membrane commonly employed on shingled roofs. The tube 32 is coupled to the second end 20 of the handle 12 and the tube 32 has a distal end 36 with respect to the second end 20 of the handle 12. Moreover, the tube 32 has a flattened portion 38 adjacent to the distal end 36 of the tube 32 and the tube 32 has an outer surface 40. The flattened portion 38 facilitates the tube 32 to be slid beneath the roll of roofing paper 34.

A skid plate 42 is coupled to the tube 32 and the skid plate 42 drags along a support surface 44 for transporting the roll of roofing paper 34. The skid plate 42 has a first surface 46 and a second surface 48, and the first surface 46 is attached to the outer surface 40 of the tube 32. The skid plate 42 conforms to curvature of the tube 32. The skid plate 42 is elongated to extend substantially between the second end 20 of the handle 12 and the distal end 36 of the tube 32. Additionally, the skid plate 42 is positioned on an outer radius of the curvature of the tube 32.

In use, the handle 12 is adjusted to a selected length to suit the user's preference and the handle 12 is gripped to position the tube 32 around the roll of roofing paper 34. In this way the roll of roofing paper 34 can be rolled out without requiring the user to stand on the roll of roofing paper 34. Additionally, the roll of roofing paper 34 can be transported by positioning the tube 32 under the roll of roofing paper 34 and subsequently dragging the skid plate 42 along the support surface 44. The indicia 24 on the handle 12 can be used to measure overlap when installing the roll of roofing paper 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roofing tool assembly being configured to grasp a roll of roofing paper, said assembly comprising:

a handle having a first portion slidably engaging a second portion such that said handle has a telescopically adjustable length, wherein said handle has a first end being associated with said first portion, said handle having a second end being associated with said second portion, said second portion having a plurality of engagement points thereon, said engagement points being spaced apart from each other and being distributed along said second portion;

a grip being coupled around said handle wherein said grip is configured to enhance gripping said handle;

a tube being coupled to said handle, wherein said tube is coupled to said second end of said handle, said tube having a distal end with respect to said second end of said handle, said tube having a flattened portion adjacent to said distal end of said tube, said tube having an outer surface, said tube being curved between said handle and said flattened portion to define a quarter circle such that said handle is oriented perpendicular to said flattened portion wherein said tube is configured to conform to the curvature of a roll of roofing paper thereby facilitating the roll of roofing paper to be rolled without requiring the user to stand on the roll of roofing paper;

a skid plate being coupled to said tube wherein said skid plate is configured to be dragged along a support surface for transporting the roll of roofing paper; and wherein said skid plate has a first surface and a second surface, said first surface being attached to said outer surface of said tube, said skid plate conforming to curvature of said tube, said skid plate being elongated to extend substantially between said second end of said handle and said distal end of said tube, said skid plate being positioned on an outer radius of the curvature of said tube.

2. The assembly according to claim 1, wherein said first portion has measuring indicia printed thereon, said measuring indicia comprising a graduated scale for measuring length.

3. The assembly according to claim 1, further comprising said grip is positioned on said first end, said grip having a plurality of finger indentations therein for receiving the user's fingers when the user grips said grip, said grip being comprised of a resiliently compressible material.

4. The assembly according to claim 1, further comprising a lock being movably coupled to said first portion of said handle, said lock releasably engaging a respective one of said engagement points on said second portion for retaining said handle at a selected length.

5. A roofing tool assembly being configured to grasp a roll of roofing paper, said assembly comprising:

a handle having a first portion slidably engaging a second portion such that said handle has a telescopically adjustable length, said handle having a first end being associated with said first portion, said handle having a second end being associated with said second portion, said second portion having a plurality of engagement points thereon, said engagement points being spaced apart from each other and being distributed along said second portion, said first portion having measuring indicia printed thereon, said measuring indicia comprising a graduated scale for measuring length;

a grip being coupled around said handle wherein said grip is configured to enhance gripping said handle, said grip being positioned on said first end, said grip having a plurality of finger indentations therein for receiving the user's fingers when the user grips said grip, said grip being comprised of a resiliently compressible material;

a lock being movably coupled to said first portion of said handle, said lock releasably engaging a respective one of said engagement points on said second portion for retaining said handle at a selected length;

a tube being coupled to said handle, said tube being coupled to said second end of said handle, said tube having a distal end with respect to said second end of said handle, said tube having a flattened portion adjacent to said distal end of said tube, said tube having an outer surface, said tube being curved between said handle and said flattened portion to define a quarter circle such that said handle is oriented perpendicular to said flattened portion wherein said tube is configured to conform to the curvature of a roll of roofing paper thereby facilitating the roll of roofing paper to be rolled without requiring the user to stand on the roll of roofing paper; and a skid plate being coupled to said tube wherein said skid plate is configured to be dragged along a support surface for transporting the roll of roofing paper, said skid plate having a first surface and a second surface, said first surface being attached to said outer surface of said tube, said skid plate conforming to curvature of said tube, said skid plate being elongated to extend substantially between said second end of said handle and said distal end of said tube, said skid plate being positioned on an outer radius of the curvature of said tube.

* * * * *